US005570945A

United States Patent [19]

Chien et al.

[11] Patent Number: 5,570,945

[45] Date of Patent: Nov. 5, 1996

[54] SOFT LIGHT-STRIP

[76] Inventors: Tseng-Lu Chien; Ping-Hsiang Wu, both of 8-6 Fl., No. 9, San Min Rd., Taipei, Taiwan

[21] Appl. No.: 421,021

[22] Filed: Apr. 12, 1995

Related U.S. Application Data

[63] Continuation of Ser. No. 156,004, Nov. 22, 1993.

[51] Int. Cl.[6] ..... F21V 9/16

[52] U.S. Cl. ..... 362/84; 362/103; 362/189

[58] Field of Search ..... 362/84, 106, 103, 362/108, 157, 105, 235, 189

[56] References Cited

U.S. PATENT DOCUMENTS

| | | | |
|---|---|---|---|
| 3,317,722 | 5/1967 | Whitney | 362/84 X |
| 4,602,191 | 7/1986 | Davila | 362/103 X |
| 4,839,777 | 6/1989 | Janko et al. | 362/108 |
| 4,891,736 | 1/1990 | Gouda | 362/105 |
| 5,128,843 | 7/1992 | Guritz | 362/103 |
| 5,151,678 | 9/1992 | Veltri et al. | 362/103 X |
| 5,245,516 | 9/1993 | de Haas et al. | 362/108 |
| 5,245,517 | 9/1993 | Fenton | 362/84 |
| 5,339,550 | 8/1994 | Hoffman | 362/84 X |

FOREIGN PATENT DOCUMENTS

| | | | |
|---|---|---|---|
| 2081069 | 2/1982 | United Kingdom | 362/103 |

*Primary Examiner*—Denise L. Gromada
*Assistant Examiner*—Thomas M. Sember
*Attorney, Agent, or Firm*—Merchant, Gould, Smith, Edell, Welter & Schmidt, P.A.

[57] ABSTRACT

A soft light-strip includes a soft lower strip detachably engaged with a transparent soft upper strip thus together constituting a sheath and a soft light-emitting device being received in the sheath for emitting light which includes a first light portion being directly emitted outward through the transparent soft upper strip and a second light portion being reflected by the soft lower strip and finally forwarded outward through the transparent soft upper strip.

4 Claims, 3 Drawing Sheets

SOFT LIGHT-STRIP

This is a File Wrapper Continuation of application Ser. No. 08/156,004, filed Nov. 22, 1993.

FIELD OF THE INVENTION

The present invention relates to a soft light-strip particularly one which is capable of emitting light and is allowed to be fixed on a vest, a cap, a shoulder bag and so on in a conventional manner.

BACKGROUND OF THE INVENTION

Some people such as joggers, street cleaners, road constructors and so on are in danger of being hit by a car or the like in bad weather. Some of the people wear a sleeveless vest with fluorescent material thereon, but on a dark, rainy night the vest still may not be easily seen. A known soft light-strip which emits light with shown in FIG. 6. This soft light-strip contains a soft bottom-strip 80, a soft upper-strip 84 which is transparent, and a plurality of light emitting diodes (LEDs) 81 being fixed therebetween. As shown in this figure, there are a plurality of holes 83 on the soft upper-strip 84 allowing the bulb portion of each LED 81 to penetrate therethrough. As can be seen, two soft light-strips as mentioned are fixed on a vest 401, with two wires 82 connecting the LEDs 81 in parallel. The wires 82 are electrically connected to a battery 52 which is positioned in a pocket 42 of the vest 401. A long housing structure 41 is fixed along an edge portion of the vest 401 for receiving a portion of the wires 82. This kind of soft light-strip can emit light actively thus it can be seen even in a dark area. However, a portion of each LED is enclosed by the hole 83 thus the luminosity of the soft light-strip is affected. Moreover, the LED has its emitting light limited in an angular range taken from a top view thereof, thus this kind of soft light-strip might be neglected if it is seen from an angle where only very weak light is emitted. It is requisite to provide a soft light-strip which emits light in a relatively broad angle comparing to the one which is installed with LEDs.

SUMMARY OF THE INVENTION

It is an object of the present invention to provide a soft light-strip including a soft lower strip detachably engaged with a transparent soft upper strip thus together constituting a sheath and a soft light means being received in the sheath for emitting light which includes a first light portion being directly emitted outward through the transparent soft upper strip and a second light portion being reflected by the soft lower strip and finally forwarded outward through the transparent soft upper strip.

DETAILED DESCRIPTION OF THE PREFERRED EMBODIMENTS

Figure 1:
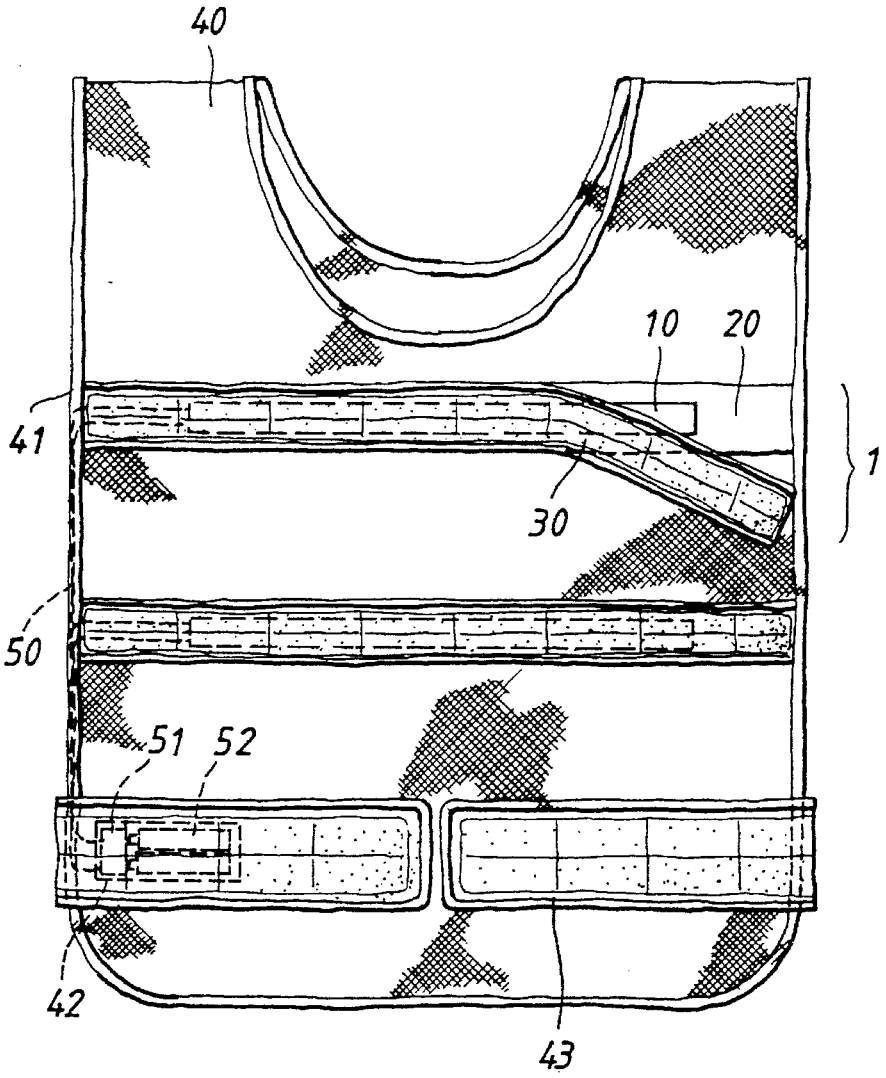
FIG. 1 illustrates two soft light-strips of the present invention fixed on a safety vest.
Figure 2:
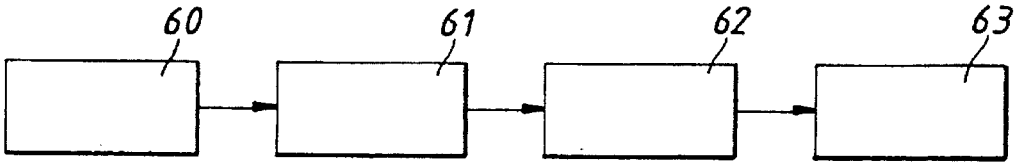
FIG. 2 is a block diagram illustrating how the soft light-strip illuminates.

Referring to FIG. 1, a soft light-strip 1 in accordance with the present invention comprises a soft lower strip 20, a transparent soft upper strip 30, and a soft light emitting means 10. The soft lower strip 20 may be made of soft plastic material and at least one side thereof has to be white color for introducing the best light reflection effect. The transparent soft upper strip 30 is detachably engaged to the lower strip 20 thus together forming a sheath. Specifically, the upper strip 30 and the lower strip 20 are detachably engaged along their outer periphery such that the central, inwardly-facing surfaces of the upper strip 30 and the lower strip 20 are not engaged. The soft light-emitting means 10 is received in the sheath for emitting light which includes a first light portion being directly emitted outward through the transparent soft upper strip 30 and a second light portion being reflected by the soft lower strip 20 and finally forwarded outward through the transparent soft upper strip 30. The soft light-emitting means 10 may be, for example, an electro-luminescent (EL) light source. The light-emitting means 10 is connected to a voltage pull-up circuit 51 and a battery 52 via a pair of electrical wires 50. The function thereof is explained in conjunction with FIG. 2. The battery 52 provides a required DC source 60 which is adjusted by voltage pull-up 61, via a function setting step 62 and enables the light-emitting means 10 to illuminate according to the manner set in the setting step 62. The function setting step 62 can set the light-emitting means 10 to illuminate in different manners such as flashing in different frequencies.

A function setting device (not shown) may be connected to the light-emitting means 10 and is operable to enable the latter to flash in different manners. Since the function setting device is a very well known device, it is not described in detail herein.

Further referring to FIG. 1, a plurality of the soft light strip 1 may be fixed on a safety vest 40. The safety vest 40 has a pocket 42 for receiving the battery 52 and the voltage pull-up device 51. Of course, the pocket 42 can be made bigger for receiving an additional function setting device (not shown). A long housing structure 41 is formed at either side of the vest 40 for receiving the wires 50. A belt 43 made of velcro-like material is formed at the lower portion of the vest 40.

Figure 3:
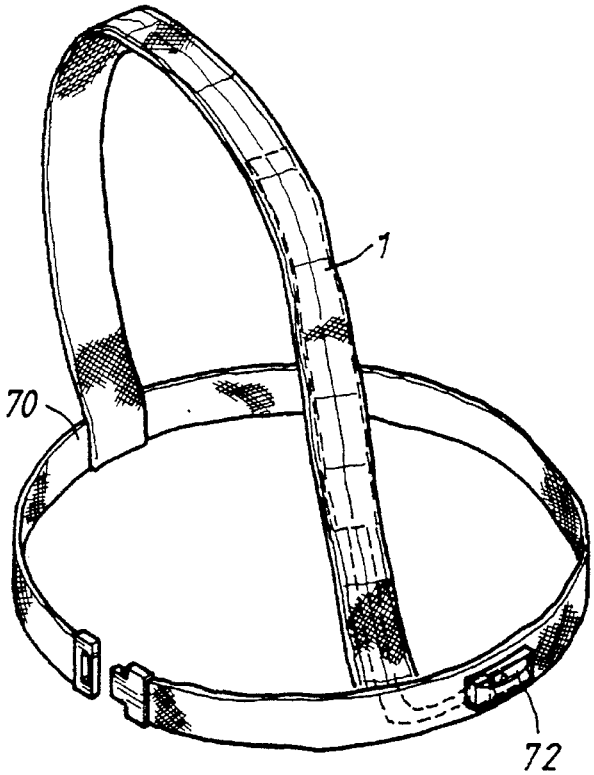
FIG. 3 illustrates the soft light-strip being fixed on a high visibility belt.
Figure 5:
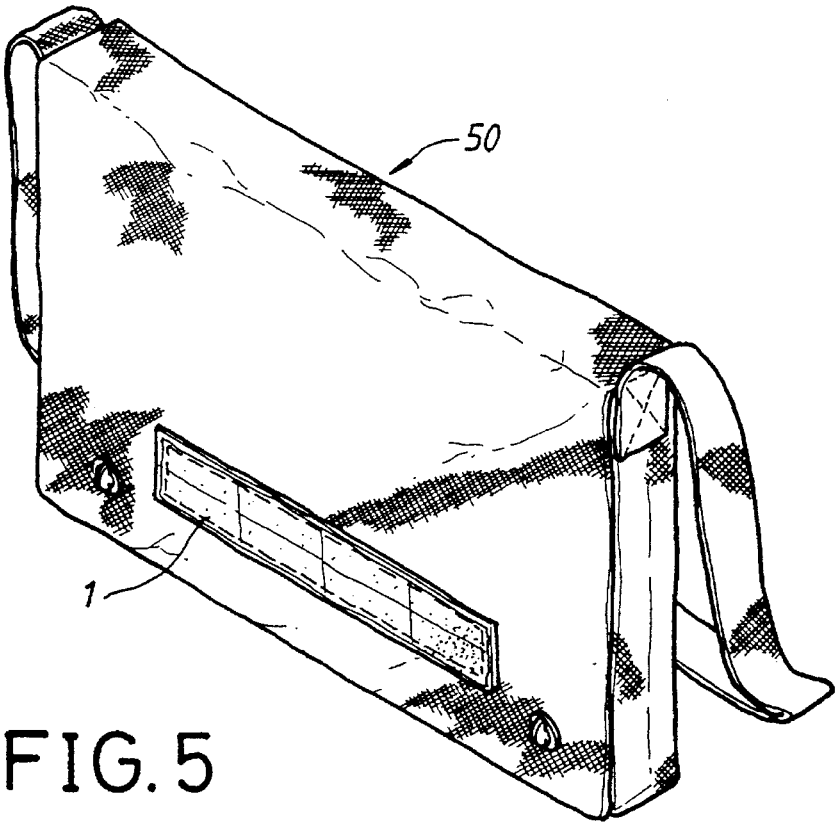
FIG. 5 illustrates the soft light-strip being fixed on a shoulder bag.
Figure 4:
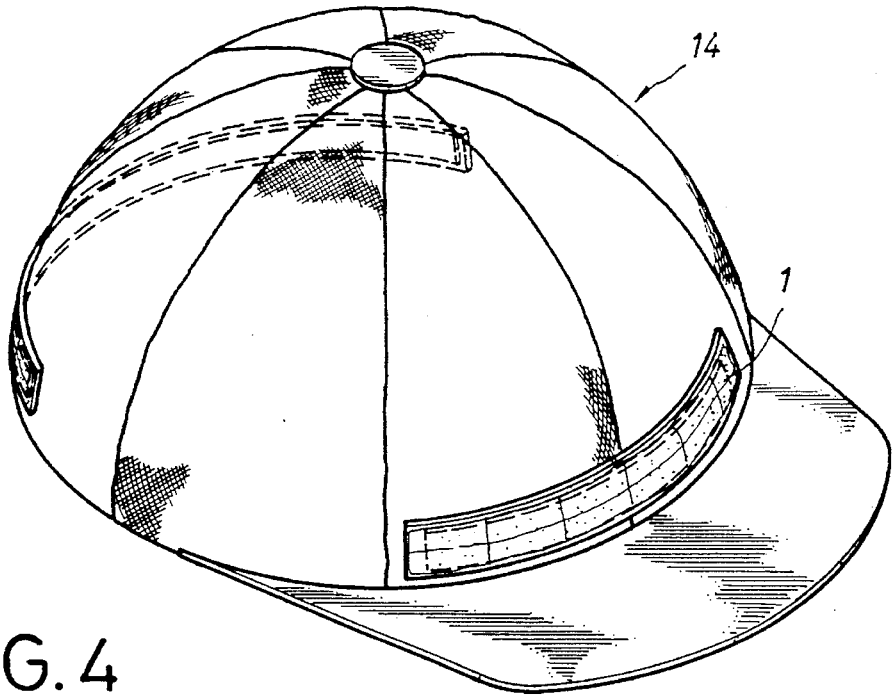
FIG. 4 illustrates the soft light-strip being fixed on a cap.
Figure 6:
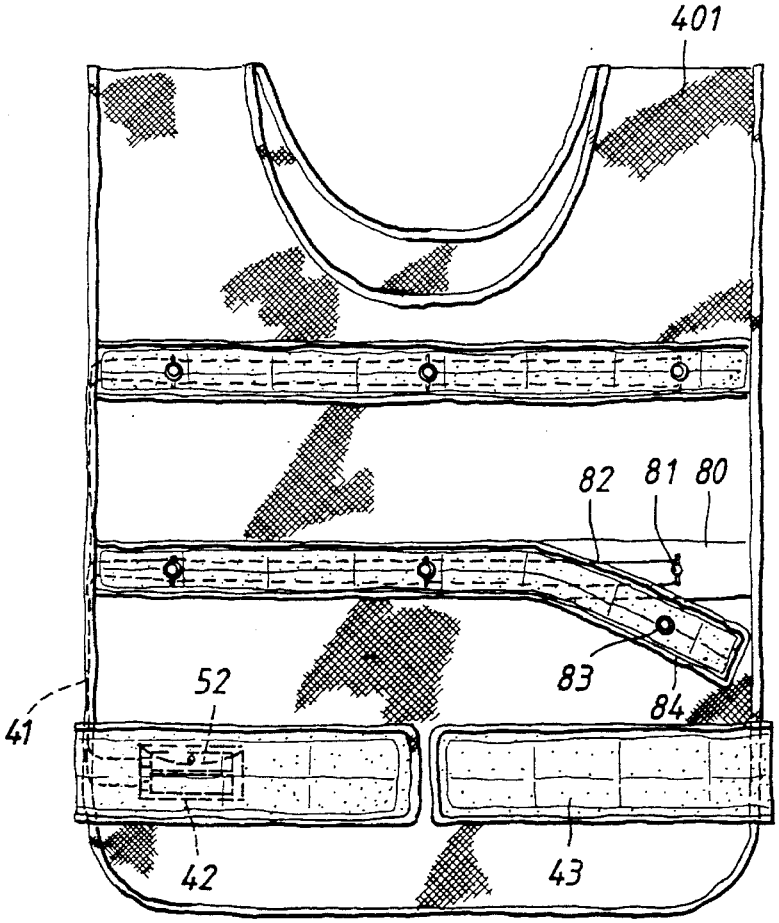
FIG.6 PRIOR ART
FIG. 6 illustrates two conventional light-strips being fixed on a safety vest.

Referring to FIG. 3, the soft light-strip 1 can be attached on a high visibility belt 70 which is usually carried by a traffic commander and includes a shoulder portion and a waist portion. A pocket 72 is attached at the waist portion of the belt 70 for receiving the battery (not shown) and the voltage pull-up device (not shown). The soft light-strip 1 may also be attached on a cap 14 as shown in FIG. 4 or on a shoulder bag 50 as shown in FIG. 5.

Although the invention has been explained in relation to its preferred embodiment, it is to be understood that many other possible modifications and variations can be made without departing the spirit and scope of the invention as hereinafter claimed:

1. A soft light strip comprising:

a sheath having a soft upper strip (30) and a soft lower strip (20), said soft upper strip (30) and said soft lower strip (20) being detachably engaged and forming an elongated central cavity substantially along the length of said sheath; central portions of inwardly-facing surfaces of said upper and lower strips being free from engagement; said soft lower strip (20) having an inwardly facing reflective surface; said soft upper strip (30) being transparent; and an elongated soft electro-luminescent component (10) being received within said sheath between said soft upper strip and said reflective surface of said soft lower strip for emitting light which includes a first light portion being directly emitted outwardly through said transparent soft upper strip (30) and a second light portion being reflected by said reflective surface of said soft lower strip (20) and finally emitted outwardly through said transparent soft upper strip (30), said elongated soft electro-luminescent component being repositionable between said upper and lower strips when said upper strip is detached.

2. A soft light-strip as claimed in claim 1 further comprising a function setting means connected to said electro-luminescent component (10) adjustable to enable said electro-luminescent component (10) to flash in different manners.

3. A soft light-strip as claimed in claim 1, wherein said electro-luminescent component is received in said sheath such that said electro-luminescent component is free from engagement with said upper and lower strips.

4. A soft light strip comprising:

a sheath having a soft upper strip (30) and a soft lower strip (20), said soft upper strip (30) and soft lower strip (20) being detachably engaged and forming an elongated central cavity substantially along the length of said sheath; central portions of inwardly facing surfaces of said upper and lower strips being free from engagement; said soft lower strip (20) having a reflective surface; said soft upper strip (30) being transparent; and an elongated soft electroluminescent component (10) being received in said sheath between said soft upper strip and said reflective surface of said soft lower strip; the electro-luminescent component being repositionable within said sheath when said soft upper strip is detached, and operable independently of said sheath.

* * * * *